US007572114B2

(12) United States Patent
Lee

(10) Patent No.: US 7,572,114 B2
(45) Date of Patent: Aug. 11, 2009

(54) STRUCTURE OF PUMP

(75) Inventor: Chin-Chuan Lee, Changhua (TW)

(73) Assignee: Sonic Tractor Parts, Inc., Miami, FL (US)

( * ) Notice: Subject to any disclaimer, the term of this patent is extended or adjusted under 35 U.S.C. 154(b) by 700 days.

(21) Appl. No.: 11/160,379

(22) Filed: Jun. 21, 2005

(65) Prior Publication Data

US 2006/0283320 A1 Dec. 21, 2006

(51) Int. Cl.
*F04B 17/00* (2006.01)

(52) U.S. Cl. ..... 417/360; 91/499; 60/458

(58) Field of Classification Search ..... 417/360, 417/423.14; 415/126; 60/458, 487; 91/499, 91/504

See application file for complete search history.

(56) References Cited

U.S. PATENT DOCUMENTS

| | | | | | |
|---|---|---|---|---|---|
| 4,352,135 | A * | 9/1982 | DeMoss et al. | ..... | 360/133 |
| 4,633,356 | A * | 12/1986 | Takahashi | ..... | 360/133 |
| 5,183,396 | A * | 2/1993 | Cook et al. | ..... | 417/534 |
| 5,492,455 | A * | 2/1996 | Durham et al. | ..... | 417/313 |
| 6,332,393 | B1 | 12/2001 | Trimble | ..... | 92/12.2 |
| 6,502,394 | B2 | 1/2003 | Trimble | ..... | 60/486 |
| 6,719,005 | B1 | 4/2004 | Trimble et al. | ..... | 137/493.6 |
| 6,761,182 | B1 | 7/2004 | Trimble et al. | ..... | 137/15.18 |
| 6,828,704 | B2 * | 12/2004 | Okamoto et al. | ..... | 310/71 |
| 6,889,595 | B1 | 5/2005 | Trimble | ..... | 92/12.2 |
| 6,964,280 | B1 | 11/2005 | Trimble et al. | ..... | 137/493.9 |
| 7,066,199 | B1 | 6/2006 | Trimble et al. | ..... | 137/493.5 |
| 7,082,762 | B1 | 8/2006 | Trimble | ..... | 60/494 |
| 2004/0191075 | A1 * | 9/2004 | Dong | ..... | 417/222.1 |
| 2005/0191190 | A1 * | 9/2005 | Maki et al. | ..... | 417/410.1 |

* cited by examiner

*Primary Examiner*—Devon C Kramer
*Assistant Examiner*—Dnyanesh Kasture
(74) *Attorney, Agent, or Firm*—Alan Kamrath; Kamrath & Associates PA

(57) ABSTRACT

A pump includes a pump housing and an end cap, which is attached to the pump housing at the top and has an oil suction port at one end and an oil relief port at one lateral side. A connecting cap is connectable to the end cap opposite to the pump housing in one of a number of positions in different directions and which has two ports cut through the two opposite ends thereof for letting in and out a fluid to/from a hydraulic motor. Two plugs are selectively fastened to one of the two ends of each of the two ports of the connecting cap to control the flow direction of the fluid passing to/from the hydraulic motor through the connecting cap.

9 Claims, 8 Drawing Sheets

STRUCTURE OF PUMP

BACKGROUND OF THE INVENTION

1. Field of the Invention

The present invention relates to a pump and, more particularly, to such a pump that can be selectively installed in one of a number of positions to fit different installation requirements.

2. Description of Related Art

In a prosperous, fast developing modem society, people become more critical to the quality of living. The old concept of merely "workable" no longer suffices. Instead, people demand better quality of products. The only way to satisfy such a demand is to keep making improvements on existing products or to even create new products.

U.S. Pat. No. 6,502,394 discloses a new design of pump. As illustrated in the specification of this patent (see FIG. 1 of the cited reference), the prior art pump 10 comprises a housing 30, an end cap 34 attached to the housing 30, and a charge pump 8 connected to the end cap 34. The end cap 34 has two ports 40 for connection to a hydraulic motor 38 by an oil piping system and has an oil port for connection to an oil reservoir through an oil pipe. When the pump 10 is installed in a powered vehicle 48 (see FIG. 2 of the cited reference), the control arm 26 has one side extended to the outside of the housing 30 to operate the vehicle. However, because the end cap 34 of the pump 10 has only one installation direction relative to the housing 30, the ports 40 of the end cap 34 allow the connection of pipes in one single direction only. This limitation results in a complicated arrangement of pipes between the pumps 10 on the right and the left side of the said vehicle, and the oil reservoir. As shown in FIG. 4 of the cited reference, in order to arrange the pipes in a good order, the control arm 26 of one pump 10 must be attached with a U shaped link 46. The use of the U shaped link 46 greatly complicates the installation procedure and increases the installation cost.

To eliminate the aforesaid limitation, a pump 50 as shown in FIG. 5 of the cited reference was developed. This pump 50 comprises a pump housing 54, an end cap 56 attached to the pump housing 54, and a charge pump 122 connected to the end cap 56. The end cap 56 has two ports 68; 70 connected to a hydraulic motor 38 through oil pipes 44 and an oil port connected to the oil reservoir. As shown in FIGS. 4 and 4B of the cited reference, the end cap 56 has two installation positions that eliminate the aforesaid limitation.

However, this design of pump still does not function satisfactorily. Because the ports 68;70 are provided at the end cap 56, pipes can be connected to the pump 50 in two positions only. Further, if an obstacle is in the way and the pipes 44 cannot be connected to the ports 68;70, the end cap 56 must be detached from the pump housing 54 and then reinstalled in the pump housing 54 after changing the direction to have the pipes 44 connected to the ports 68;70. This position changing procedure is complicated. Further, because the end cap 56 has only two installation positions, the pump 50 still does not fit different installation conditions.

Therefore, it is desirable to provide a pump that eliminates the aforesaid drawbacks.

SUMMARY OF THE INVENTION

The present invention has been accomplished to eliminate the aforesaid drawbacks and to fit different installation conditions. It is the main object of the present invention to provide a pump which allows for the connection of pipes in different directions to fit different installation requirements.

To achieve this and other objects of the invention, the pump comprises a pump housing and an end cap attached to a top side of the pump housing. The end cap includes an oil suction port at one end thereof and an oil relief port at one lateral side thereof. A connecting cap is connectable to a top side of the end cap opposite to the pump housing in one of a number of positions in different directions. The connecting cap includes two ports cut through two opposite ends thereof for letting in and out a fluid to/from a hydraulic motor. Two plugs are adapted to selectively seal one end of each of the two ports of the connecting cap to control the flow direction of the fluid to/from the hydraulic motor through the connecting cap.

DETAILED DESCRIPTION OF THE PREFERRED EMBODIMENT

Figure 1:
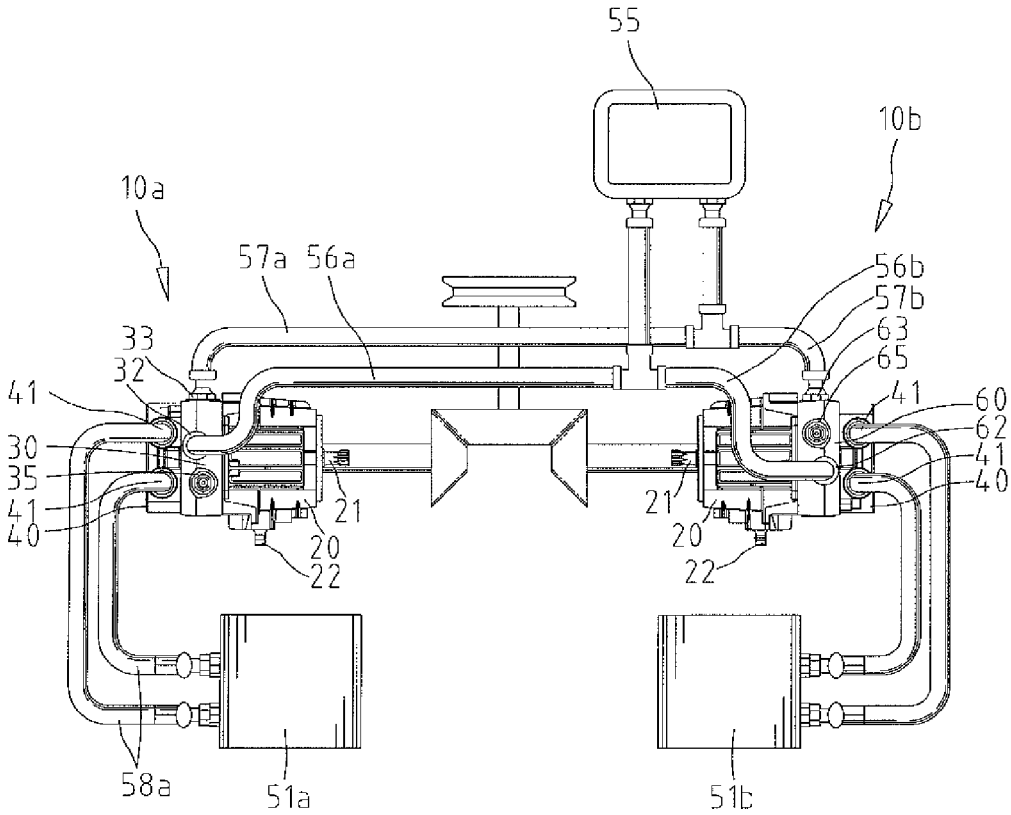
FIG. 1 is a schematic drawing showing two symmetric pumps installed in a powered device according to the present invention.
Figure 2:
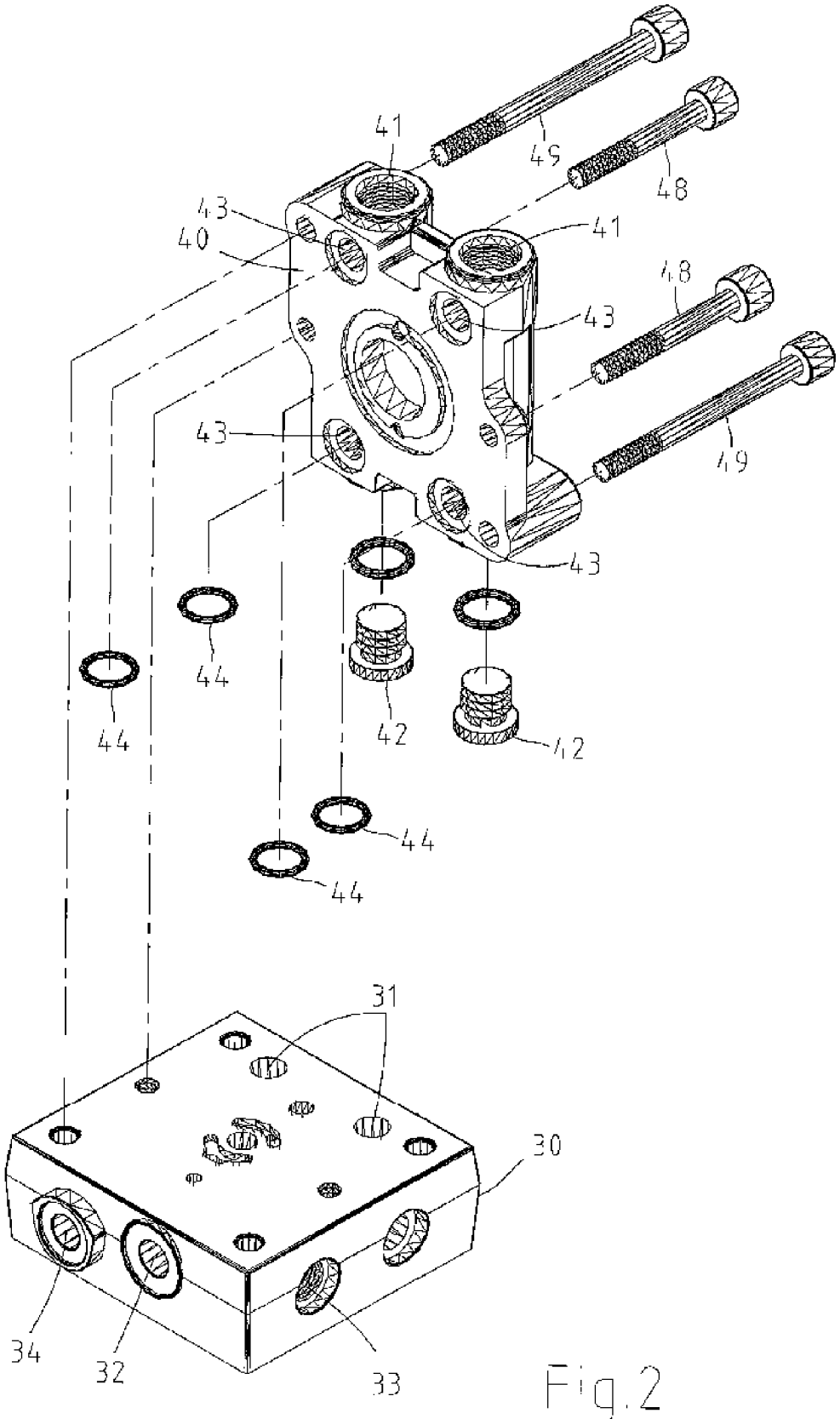
FIG. 2 is an exploded view of a part of the present invention, showing the structure of the end cap and the connecting cap.
Figure 3:
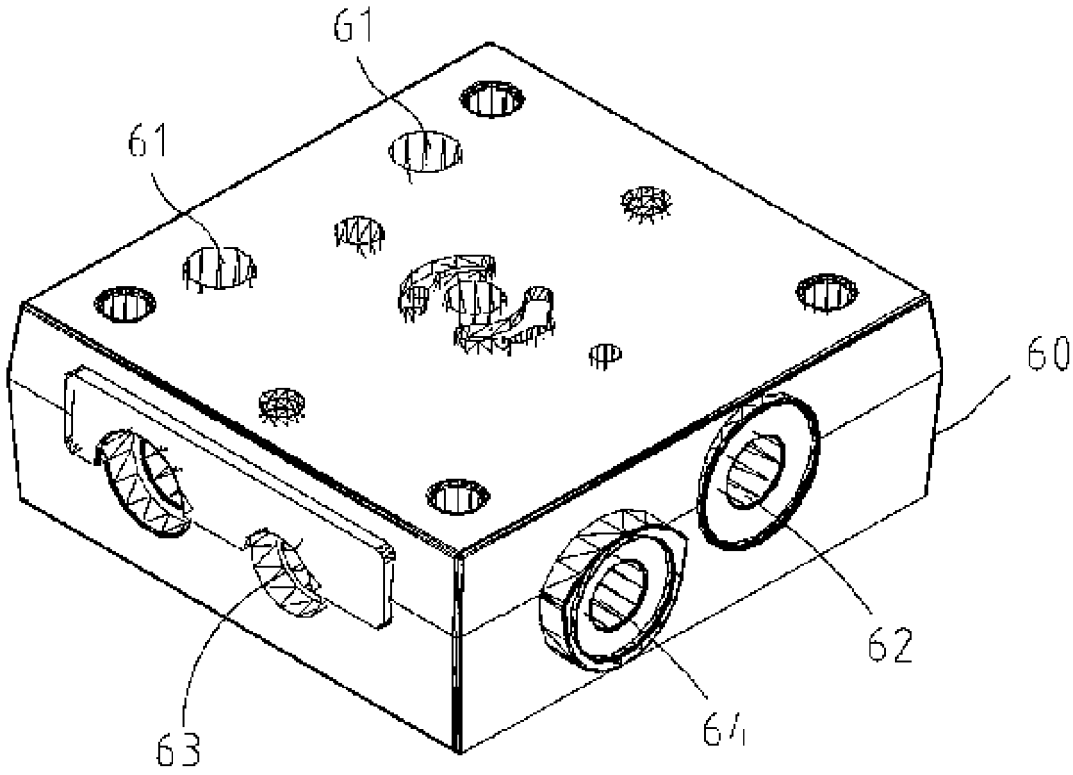
FIG. 3 is an enlarged view of an alternative form of the end cap according to the present invention.

Referring to FIGS. 1-3, a pump 10*a* is shown comprising a pump housing 20, an end cap 30, and a connecting cap 40. The end cap 30 is capped on the pump housing 20. The connecting cap 40 is capped on the end cap 30 and can be adjusted to a series of positions in different directions to fit different installation requirements.

The pump housing 20 has a pump shaft 21 inserted through one end thereof and a control arm 22 provided at one lateral side thereof. Because the structure of the pump housing 20 and its internal parts are similar to conventional designs, no further detailed description in this regard is necessary.

The end cap 30 is capped on the pump housing 20 in a watertight manner. The end cap 30 includes a first end and a second end, two ports 31 disposed at the top side of the first end, an oil suction port 32 disposed at the second end and connected to an oil reservoir 55 through an oil pipe 56*a*, and a by-pass valve port 34 disposed at the second end adjacent to the oil suction port 32 at one side. A by-pass valve 35 is mounted in the by-pass valve port 34. An oil relief port 33 is disposed at one lateral side and connected to the oil reservoir 55 through an oil pipe 57*a*. Because the arrangement of the internal passages of the end cap 30 is of known art, no further detailed description in this regard is necessary.

The connecting cap 40 is connected to the top wall of the end cap 30 in a watertight manner and is 180° rotatable relative to the end cap 30. The connecting cap 40 comprises two ports 41 extending through the two opposite ends thereof for input/output of a fluid to/from a hydraulic motor 51*a*. Two plugs 42 are selectively fastened to the ports 41 to control the flow direction of the fluid through the two ports 41. The connecting cap 40 further comprises two pairs of oil access holes 43 respectively disposed at the bottom side near the two opposite ends. The two oil access holes 43 near one end of the connecting cap 40 are respectively connected to the ports 31 at the top side of the end cap 30, allowing fluid communication between the two oil ports 41 and the ports 31. The top wall of the end cap 30 blocks the other two oil access holes 43. An O-ring 44 is respectively fastened to each of the oil access holes 43 to prevent leakage. An index 45 (see FIG. 5) is provided at the surface of the connecting cap 40 to indicate the direction of forward or backward rotation of the pump shaft 21. According to this embodiment, the index 45 is a triangular mark. Long screw bolts 49 are inserted through the connecting cap 40 and the end cap 30 to secure the connecting cap 40 and the end cap 30 to the pump housing 20. Short screw bolts 48 are installed to affix the end cap 30 and the connecting cap 40 together.

FIG. 1 shows a second pump 10*b* arranged in a symmetric manner. This second pump 10*b* is the same as the aforesaid pump 10*a* with exception of the design of the end cap 60 (FIG. 3). The end cap 60 of this second pump 10*b* has a first end and a second end, two ports 61 disposed at the top side of the first end, an oil suction port 62 disposed at the second end and connected to an oil reservoir 55 through an oil pipe 56*b*, and a by-pass valve port 64 disposed at one side of the oil suction port 62 at the second end. A by-pass valve 65 is mounted in the by-pass valve port 64. An oil relief port 63 is disposed at one lateral side and connected to the oil reservoir 55 through an oil pipe 57*b*. The connecting cap 40 of the second pump 10*b* comprises two ports 41 extending through the two opposite ends thereof for input/output of a fluid to/from a hydraulic motor 51*b*. Because the arrangement of the internal passages of the end cap 60 is of known art, no further detailed description in this regard is necessary. After installation, the oil pipes 57*a*;57*b* are respectively connected between the pumps 10*a*; 10*b* and the oil reservoir 55. According to this design, the length of the oil pipes 57*a*;57*b* is minimized, and The oil pipes 57*a*;57*b* are arranged in a neat status.

Figure 4:
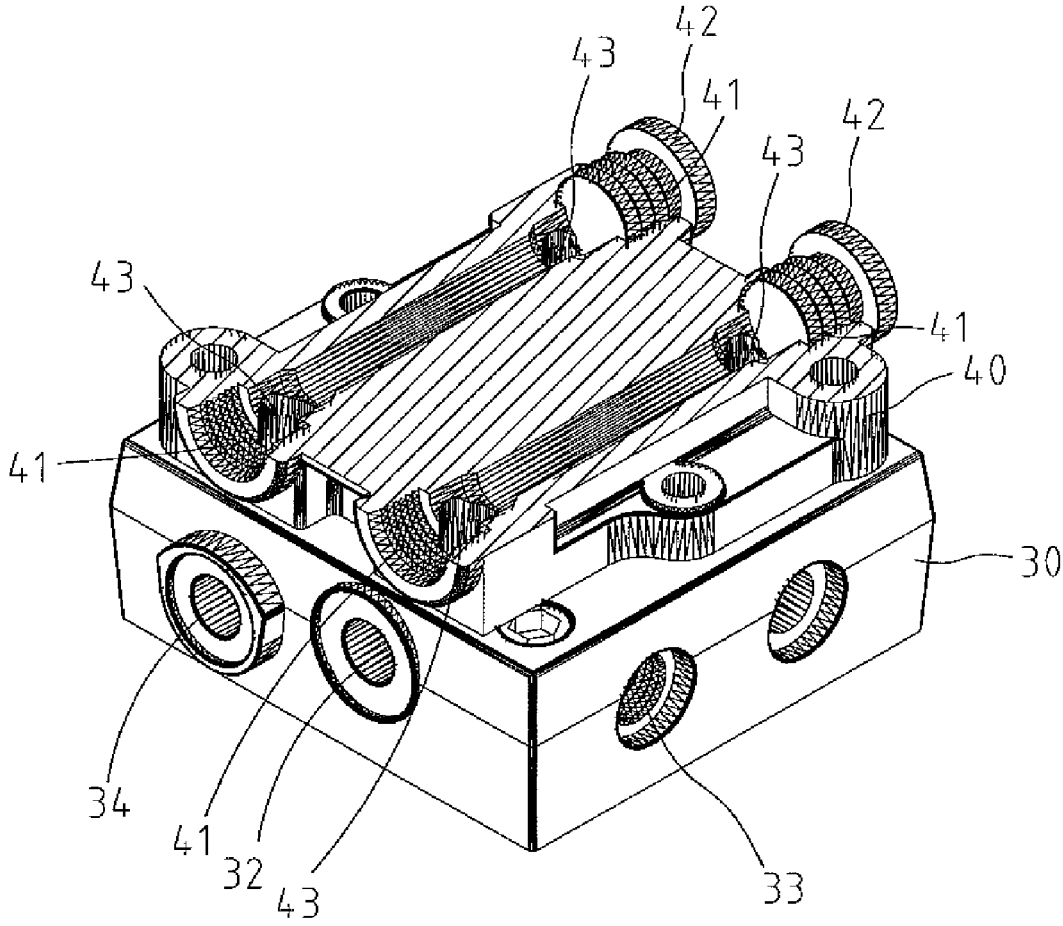
FIG. 4 is a cross sectional view of the connecting cap according to the present invention.

FIG. 4 is a sectional view of the connecting cap 40. As illustrated, the two ports 41 cut through the two opposite ends of the connecting cap 40. The two plugs 42 are respectively fastened to the ports 41 at one end of the connecting cap 40, keeping the other end of each of the ports 41 open. The two ports 41 are respectively provided for letting the fluid in or out. Further, the two ports 41 are in fluid communication with the port 31 of the end cap 30 through the oil access holes 43.

Figure 5:
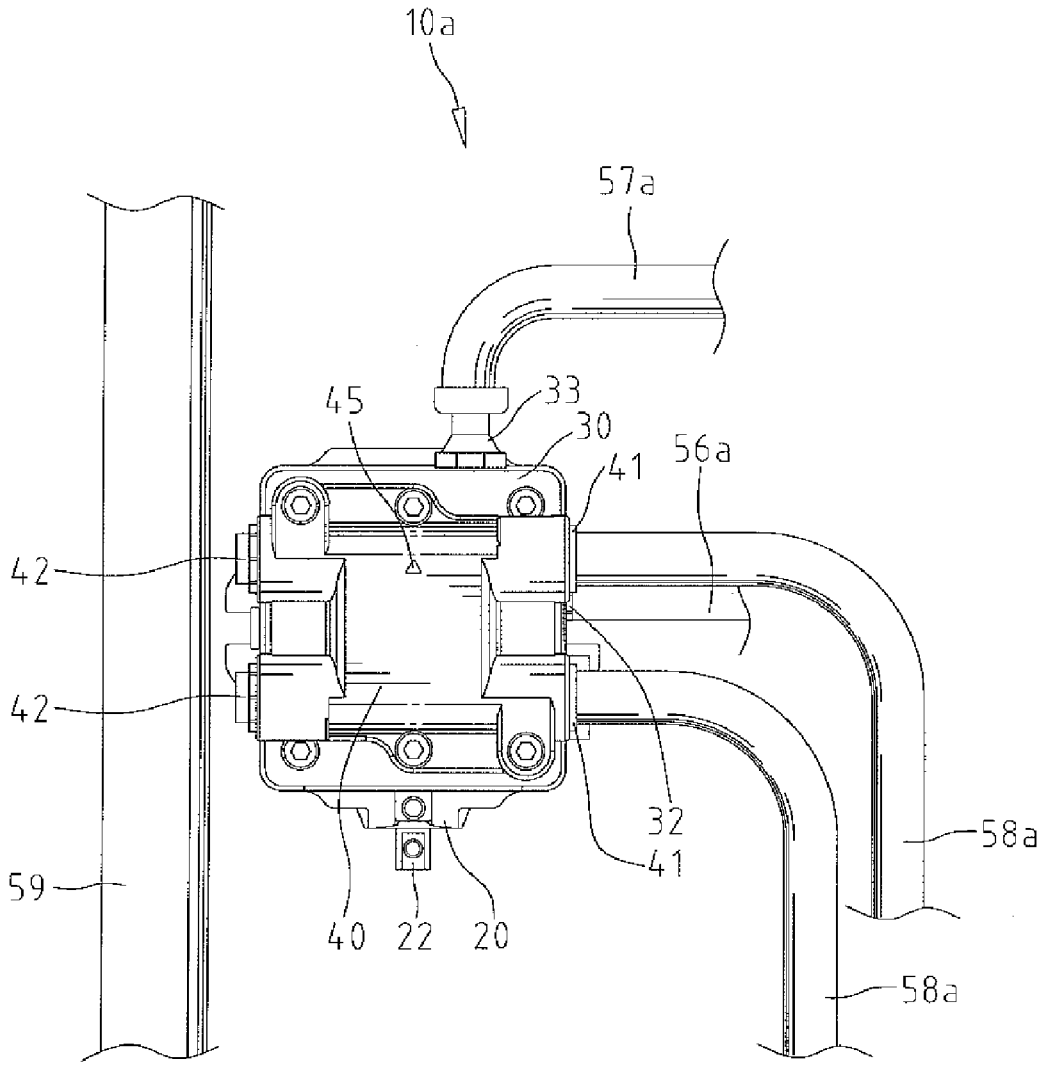
FIG. 5 is a left side view in an enlarged scale of FIG. 1.

FIG. 5 is the left side view of FIG. 1, showing the structure of one end of the connecting cap 40 of the pump 10*a* and an obstacle 59 at the left side of the pump 10*a*. In this case, the left side of the pump 10*a* is not suitable for the arrangement of the oil pipes 58*a*. Therefore, the plugs 42 are fastened to the ports 41 at the left side of the connecting cap 40, and the oil pipes 58*a* are respectively connected to the ports 41 at the right side of the connecting cap 40.

Figure 6:
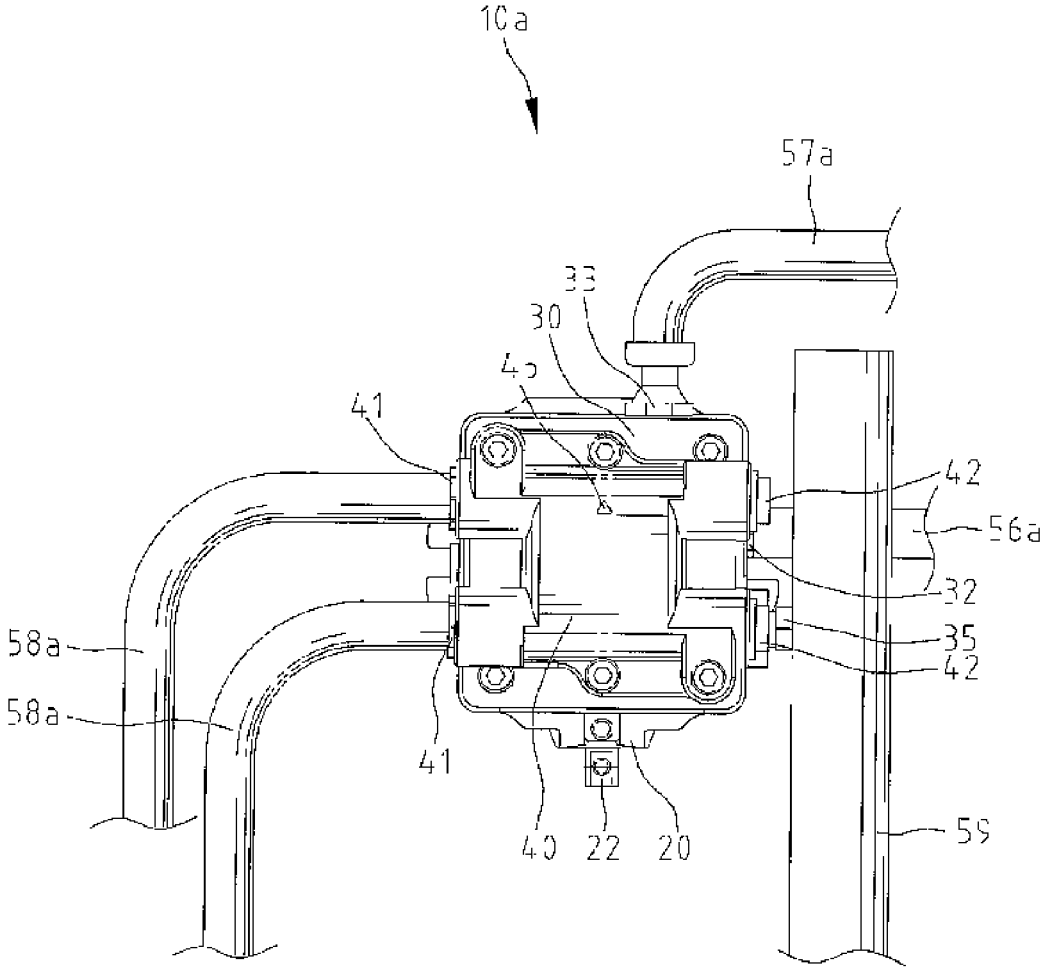
FIG. 6 is a schematic drawing showing another installation alternative of the present invention.

FIG. 6 shows a second installation alternative of the present invention. According to this installation, the obstacle 59 is at the right side of the pump 10*a*. Therefore, the plugs 42 are fastened to the ports 41 at the right side of the connecting cap 40, and the oil pipes 58*a* are respectively connected to the ports 41 at the left side of the connecting cap 40 without changing the position of the hydraulic motor 51*a*. This design allows quick installation of the oil pipes 58*a* without dismounting the end cap 30 and the connecting cap 40, thereby simplifying the maintenance work and reducing the installation cost.

Figure 7:
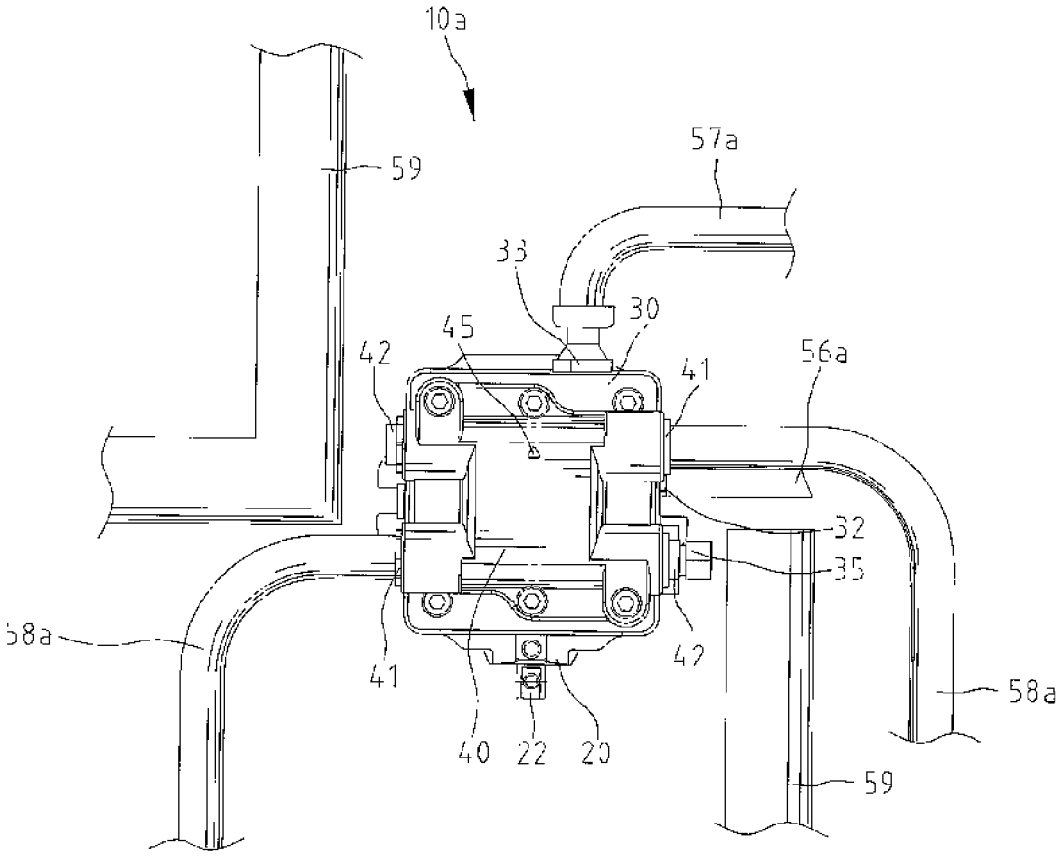
FIG. 7 is a schematic drawing showing still another installation alternative of the present invention.
Figure 8:
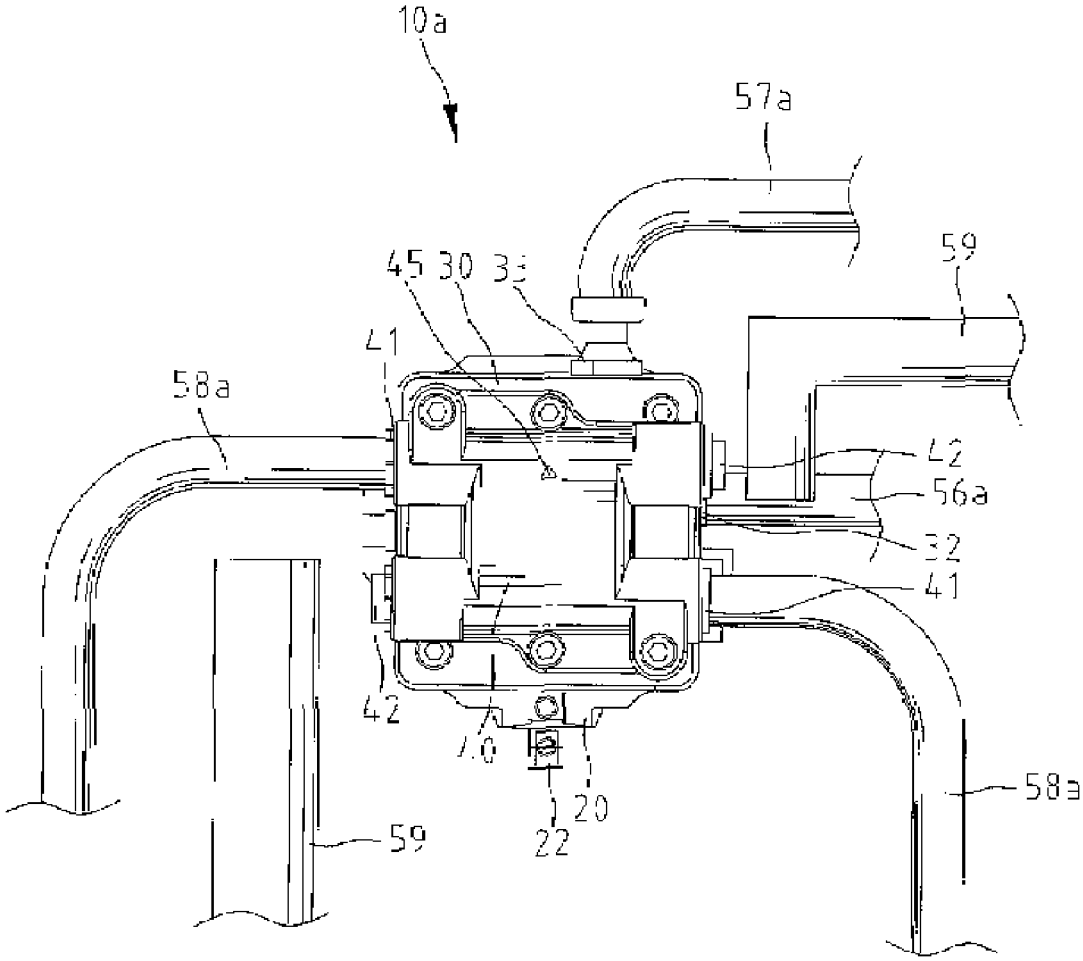
FIG. 8 is a schematic drawing showing still another installation alternative of the present invention.

FIGS. 7 and 8 show two different installation alternatives of the present invention. As illustrated, the invention allows installation of the oil pipes 58*a* in different directions at different elevations, i.e., the pump 10*a* can conveniently be installed in one of a variety of ways to fit different environment conditions. 3. The end caps of the two symmetric pumps have a respective oil relief port in different direction so that the end caps of the two symmetric pumps can be respectively connected to the oil reservoir with short oil pipes and the oil pipes can be arranged in a neat status.

As indicated above, the invention has many advantages as outlined hereinafter.

1. The connecting cap 40 of the pump 10*a* has two ports 41 cut through the two opposite ends for the easy connection of oil pipes 58*a* in different directions selectively.

2. The connecting cap 40 of the pump 10*a* has two ports 41 cut through the two opposite ends for the connection of oil pipes 58*a* from one side as well as from both sides.

3. The end caps 30;60 of the two symmetric pumps 10*a*;10*b* have a respective oil relief port 33;63 in a different direction. Thus, the end caps 30;60 of the two symmetric pumps 10*a*; 10*b* can be respectively connected to the oil reservoir 55 with short oil pipes 58*a*, and the oil pipes 57*a*;57*b* can be arranged in a neat status.

The improved structure of the pump functions smoothly to provide all of the features discussed hereinbefore.

Although the present invention has been explained in relation to its preferred embodiments, it is to be understood that many other possible modifications and variations can be made without departing from the spirit and scope of the invention as hereinafter claimed.

What is claimed is:

1. A pump comprising:

a pump housing;

an end cap attached to a top side of said pump housing, said end cap comprising an oil suction port at one end thereof and an oil relief port at one lateral side thereof;

a connecting cap connectable to a top side of said end cap opposite to said pump housing in first and second positions, with the first and second positions being in different directions, said connecting cap comprising two ports cut through two opposite ends thereof for letting in and out of a fluid to/from a hydraulic motor; and two plugs adapted to selectively seal one end of each of the two ports of said connecting cap to control the flow direction of the fluid passing to/from said hydraulic motor through said connecting cap; and wherein said connecting cap further comprises four oil access holes respectively disposed at a bottom side thereof corresponding to each end of each of the two ports of said connecting cap; said end cap further comprises two ports disposed at the top side thereof remote from said oil suction port and respectively provide fluid communication with the oil access holes near one end of each of the two ports of said connecting cap; with the connecting cap being removably connected to the top side of said end cap; with the bottom side of the connecting cap being removably connected to the top side of the end cap; with the two ports of the end cap being aligned with two of the four oil access holes and providing fluid communication therewith during assembly in the first position with another two of the four oil access holes being blocked by the top side of the end cap by assembly of the connecting cap to the end cap and preventing fluid communication into or out of the other two of the four oil access holes in the first position, with the two ports of the end cap being aligned with the other two of the four oil access holes and providing fluid communication therewith during assembly in the second position, with said two of the four oil access holes being blocked by the top side of the end cap by assembly of the communication cap to the end cap and preventing fluid communication into or out of the said two of the four access holes in the second position.

2. The pump as claimed in claim 1, wherein said four oil access holes of said connecting cap are respectively peripherally sealed with an O-ring.

3. The pump as claimed in claim 1, wherein said end cap comprises a by-pass valve port disposed adjacent to one side of said oil suction hole, and a by-pass valve mounted in said by-pass valve port.

4. The pump as claimed in claim 3, wherein said oil relief port is disposed at one lateral side adjacent to said oil suction port of said end cap.

5. The pump as claimed in claim 3, wherein said oil relief port is disposed at one lateral side adjacent to said by-pass valve port of said end cap.

6. The pump as claimed in claim 1, wherein said connecting cap is horizontally 180° rotatable relative to said end cap between the first and second positions.

7. The pump as claimed in claim 6, wherein said connecting cap further comprises an index disposed at a top side thereof and adapted to indicate the direction of forward/backward rotation of said connecting cap relative to said end cap.

8. The pump as claimed in claim 1, further comprising bolts fixing the end cap and the connecting cap together.

9. The pump as claimed in claim 8 further comprising an O-ring fastened to each of the other two of the four oil access holes.

* * * * *